US005460641A

United States Patent [19]

Åslund et al.

[11] Patent Number: 5,460,641

[45] Date of Patent: Oct. 24, 1995

[54] METALLIC POWDER FOR PRODUCING PIECES BY COMPRESSION AND SINTERING, AND A PROCESS FOR OBTAINING THIS POWDER

[75] Inventors: Christer Åslund, Torshalla, Sweden; Claude Quichaud, Ville d'Avray, France

[73] Assignee: Valtubes, Boulogne-Billancourt, France

[21] Appl. No.: 268,117

[22] Filed: Jul. 6, 1994

[30] Foreign Application Priority Data

Jul. 6, 1993 [FR] France ..... 93 08535

[51] Int. Cl.[6] ..... B22F 1/00

[52] U.S. Cl. ..... 75/255; 75/252

[58] Field of Search ..... 75/252, 255, 370, 75/371, 374

[56] References Cited

U.S. PATENT DOCUMENTS

| | | | |
|---|---|---|---|
| 4,006,838 | 2/1977 | Baumann et al. | 75/252 |
| 4,787,934 | 11/1988 | Johnson et al. | 75/252 |
| 5,126,104 | 6/1992 | Anand et al. | 419/12 |

FOREIGN PATENT DOCUMENTS

| | | |
|---|---|---|
| 0029389 | 5/1981 | European Pat. Off. . |
| 4027887C2 | 3/1992 | Germany . |

*Primary Examiner*—Scott Kastler

*Attorney, Agent, or Firm*—Oblon, Spivak, McClelland, Maier & Neustadt

[57] ABSTRACT

The invention is concerned with the production of pieces by powder metallurgy, and, more particularly, the use of powders with spherical particles, such as those obtained by pulverisation, in a gas of a liquid metal or alloy.

The metallic powder according to the invention is constituted by granules, each of these comprising an assembly of spherical particles which have been agglomerated by at least 0.5% of gelatin.

This powder is prepared by mixing with the spherical particles an aqueous solution of gelatin; a paste is thus obtained which is broken in such a way that granules are obtained by calibration and drying.

Application to the production of pieces made of non-oxidising, fire-proof, or other, steels or alloys.

17 Claims, No Drawings

METALLIC POWDER FOR PRODUCING PIECES BY COMPRESSION AND SINTERING, AND A PROCESS FOR OBTAINING THIS POWDER

The metallic powder which is the object of the invention is involved with the production of pieces by compression and sintering from stainless steels, other non-oxidising or Fire-proof metals or alloys, and alloyed steels intended to produce quality pieces.

To produce these pieces by compression and sintering, powders are currently mostly used with angular particles obtained by pulverisation of liquid metal by pressurised jets of water using various methods known to the skilled person.

Despite the Fact that methods For the pulverisation of liquid metal by pressurised jets of water have long been the most used methods for producing metallic powders, these methods have the serious drawback that they give rise to metallic powders with a high oxygen content.

A method is also known of preparing metallic powders by pulverisation of a liquid metal or alloy using a gaseous jet which may be a neutral gas, for example, such as argon or nitrogen, or any suitable gas. Powders are thus obtained which have a much lower oxide content than the powders obtained through pulverisation by water, and which have substantially the same purity as the initial metal.

However, the elementary particles of these powders are substantially spherical in shape, but, as such, are not easily shaped.

In fact, after compression and sintering, these powders make it possible to obtain pieces by compression whose apparent density is at least equal to that made possible by conventional angular powders. However, during the initial stage where the powder is formed by cold compression in a mould, the crude piece obtained From spherical particles has a mechanical strength which is often inadequate to enable it to be handled, and, in particular, to be ejected From the mould, and then transferred to the sintering furnace, without anypeeling or cracking.

With some applications which do not involve powders with spherical particles, a proposal has been made to add to the powders used to obtain pieces by compression and sintering, various binding agents which are based on organic compounds. Thus, the U.S. Pat. No. 4,456,484 describes the addition of an organic binding agent to a mixture of fire-proof metallic carbide powder with another metallic powder which itself acts as a metallic binding agent. As the binding agent an amide is used which is a wax. The mixture of these 3 components is crushed in the presence of a liquid such as water in which the wax is insoluble, and, after drying, since the wax forms a bond between the carbide particles and those of the metallic binding agent, compression is carried out, followed by sintering.

Patent Application GB 2 228 744 describes a similar method for joining together alloy elements such as graphite, phosphorus, or others, with a base metal. According to this method, the binding agent used is a mixture of an acrylic acid ester with a methacrylic acid ester and a non saturated polymerisable acid.

These components are placed in solution in toluene.

The intended aim is to avoid Finer or lighter particles, such as graphite, or others, from becoming segregated from a base metal, such as iron, by binding the particles together.

The documents in no way seek to use such organic binding agents to improve the crude mechanical strength off the moulded pieces.

Moreover, after use, these binding agents have to be removed before or during sintering, and contamination of the metallic powders by some components of the binding agents is often observed.

Finally, it will be appreciated that it is not sufficient to improve the bond between a small amount off a fine powder such as graphite and between the coarser powder particles, e.g. of iron, in order to improve the mechanical strength of a moulded piece.

A possible way has been sought of modifying the forming capabilities of a metallic powder constituted by spherical particles in order to obtain pieces, after forming, which have much greater mechanical strength in the crude state than that which results if said powder used on its own is compacted.

The possibility has also been studied of imparting such properties to the metallic powder in a lasting way, the powder which can be Formed and sintered being capable of being transported long distances and being capable of being stored without losing its forming and sintering capacities.

Finally, the possibility has been studied of having simple implementation of a powder such as this, where possible additives do not require any special treatment prior to sintering for removing them except possibly short treatment at 300° to 500° C. for the removal of lubricants such as zinc stearate, such a treatment being customary in compression-sintering processes of metallic powders.

The metallic powder based on spherical particles which is capable of cold compression forming Followed by sintering and which is the object of the invention and also the process For the preparation of this powder which is also the object of the invention make it possible to solve all the problems thus posed.

The metallic powder according to the invention is constituted by an assembly of granules, each comprising a group of elementary spherically shaped metallic particles which are agglomerated by gelatin which constitutes at ].east 0.5% of the weight of the metallic powder.

The spherical particles are advantageously obtained by way of a pulverisation process by means of a gas which can be air or a neutral gas or a reducing gas, such as $N_2$, $H_2$, $NH_3$, Ar, or another gas, of a liquid metal or alloy.

The main metals or alloys which can be used are, for example, stainless steels, non-oxidising metals or alloys, or fire-proof metals or alloys, or alloyed steels with high mechanical properties. The sizes of the elementary particles and those of the granules are selected mainly as a function of the dimensions and characteristics, particularly of density, of the moulded pieces which are to be produced.

It is noted that in order to obtain a piece by way of cold shaping under pressure which has adequate mechanical strength in the crude state, it is preferable if each granule comprises a sufficient number of spherical particles agglomerated by gelatin. These granules must also be capable of correctly Filling the smaller recesses of the mould. However, a certain number of granules can be constituted by isolated elementary particles coated with gelatin, without harming the quality of the end product obtained.

Usually, a maximum diameter "$d_1$" is determined for the elementary spherical particles and a maximum width "$d_2$" of the granules obtained. It is noted that the powder according to the invention must preferably have a $d_2/d_1$ ratio of 3 in order that the pieces which are cold moulded under pressure have sufficient mechanical strength.

Particularly advantageously, this $d_2/d_1$ ratio can reach at least 4, or more. By way of example, with a powder whose spherical particles have a maximum diameter "$d_1$" of 100 microns, a maximum width "$d_2$" of the granules of 300 microns forms a bottom limit.

To obtain even better results, the granules must be given a maximum width "$d_2$" of 500 microns, for example, which thus corresponds to a $d_2/d_1$ ratio=5.

The content of gelatin must be determined as a function of the average size of the elementary spherical particles which are agglomerated by the gelatin. This content is also dependent on the gelling strength of the gelatin. The gelling strength is expressed in Bloom (standardised unit) and can vary between 50 and 250 blooms as a function of the gelatin used.

The use of gelatins of greater Bloom strength can permit a reduction in the percentage of gelatin in the granules and thus bring the time duration for elimination of the gelatin before the actual sintering phase at high temperature is reached to a minimum.

Despite the fact that the granules whose elementary spherical particles are agglomerated by means of the gelatin do not stick to the walls of the moulds, even when those walls are heated to temperatures of up to 100° C. or more, it is possible to carry out lubrication using a small amount of Zn stearate or another suitable lubricant.

The invention is also concerned with the process for the preparation of a metallic powder with a base of elementary spherical particles which are capable of cold compression forming and subsequent sintering.

According to this process, the elementary spherical particles are agglomerated into granules. To this end, gelatin in the form of an aqueous solution is added to the initial elementary spherical particles, the amount of water used being in the order of two to five times the quantity of gelatin, and the temperature of the water being between 40° and 80° C. As indicated hereinabove, the amount of gelatin to be used depends on the size of the elementary spherical particles, and also on the gelling strength of the gelatin. The mixture of elementary particles and of the gelatin solution is triturated for the length of time needed to moisten the metallic particles and during cooling a gel gradually forms. Partial drying is preferably carried out for example by blowing a gaseous current which enables the mixture to be given a pasty consistency, and this paste is then broken, for example by pressing it onto a sieve with a mesh size determined in dependency on the diameter of the elementary spherical particles.

Granules are thus formed which are then dried until the water, preferably as much water as possible, is removed. The operation ends preferably with a final calibration step enabling the granules to be properly isolated by separating them and also to be given relatively uniform dimensions. The amount of gelatin contained in the granules is at least 0.5% of the weight of the metallic powder obtained.

It is possible to separate the fine particles using a sieve of suitable mesh size. It will be noted that if the maximum diameter "$d_1$" of the elementary spherical particles and the width "$d_2$" of the granules obtained after drying are in a $d_2/d_1$ ratio of at least 3, and, preferably, 4 or more, it is possible to obtain pieces by cold compression in a mould with a mechanical strength in the crude state which is much greater than the mechanical strength of the same powder with spherical particles which have not been agglomerated into granules.

Prior to forming, it is advantageously possible to incorporate a lubricant such as zinc stearate into the powder thus constituted by granules.

After compression, the lubricant and the gelatin are removed by pre-heating the crude piece which has been compressed to a temperature usually within the range of 300° to 500° C.

The pre-heating can be carried out in air or in the presence of a neutral gas or a reducing gas such as Ar, $H_2$, $NH_3$, or other gas. After the gelatin and lubricant have been completely eliminated, if present, sintering is carried out at a suitable temperature for the material in order to obtain the desired densification.

After cooling it is noted that although all parameters remain the same, the pieces obtained, such as the stainless steel pieces, have an apparent density which is usually greater than that of the pieces prepared from angular powders of the same composition, and that they also have better mechanical properties in terms of ductility.

It seems that practically all the non-oxidising or fireproof metals or alloys capable of being pulverised in the form of spherical particles can undergo transformation by powder metallurgy by virtue of the process according to the invention for agglomerating the spherical particles into granules.

The examples hereinafter, given non-limitatively, describe the characteristics of the metallic powder which has been agglomerated into granules with a base of elementary spherical particles capable of cold compression forming followed by sintering according to the invention. The examples also describe, likewise in non-limitative manner, an embodiment of one such agglomerated powder and a method of using this powder to produce pieces by compression in a mould followed by sintering.

EXAMPLE 1

This example is concerned with the process according to the invention for the preparation of a metallic powder which is agglomerated into granules from elementary spherical particles which have the capacity to be formed by cold compression and sintering according to the invention.

The spherical particles used are obtained in the known way by pulverisation with a neutral gas of a stainless steel bath whose composition is equal to grade 316 as defined by the ASTM standard. A batch of these particles is prepared using a sieve, with a particle diameter not greater than 106 microns. An aqueous solution with a base of deionised water is prepared which contains 30% by weight of a gelatin whose gelling strength is 50 blooms. The solution is heated to between 50° and 70° C. to completely dissolve the gelatin.

A mixture is made which contains 95% steel 316 particles of diameter not greater than 106 microns and 5% aqueous solution, that is to say 1.5% by weight of gelatin. A thorough mixture has to be made in order to moisten the entire surface of the elementary particles with solution.

As the solution gradually cools, the gel is formed. Some of the water is allowed to evaporate by the blowing of air, and the mixture of pasty consistency is passed through a sieve with an approximate mesh size of 630 microns.

Granules are thus obtained. These latter are dried by cold or hot air, and then a second sieving stage is carried out in order to separate the granules from each other and in order to calibrate them by passing them through a sieve with a mesh size of 500 microns.

Granules are thus obtained whose size ratio compared with the maximum diameter of the metallic particles is at least 4.7. The dried granules are constituted by agglomerated spherical metallic particles which are firmly bonded together by films of gelatin, but some granules can be constituted by isolated elementary particles coated with gelatin.

It is noted that the powder thus agglomerated into granules is capable of being cold compressed in a mould to form pieces with a mechanical strength in the crude state which is very much superior to that obtained with the initial metallic particles. If a small quantity of lubricant such as zinc stearate is added to the powder which has agglomerated into particles, this further facilitates the forming operation. Removal from the mould is also facilitated by the fact that the solidified gelatin does not stick to the walls of the moulds when these latter are heated.

Using the powder which has agglomerated into granules according to the invention and to which about 0.75% by weight of zinc stearate has been added, a series of tension test bars is produced by cold compression in a mould in accordance with ASTM standard B312 with two different compression rates of 314 and 422 MPa.

The measurements taken of the mechanical strength of the tension applied in the crude state to part of the test bars give the following respective results for breaking load: 6.55 and 9.65 MPa (950 and 1400 psi). These values are perfectly satisfactory because they are clearly better than the minimum value of 3.44 MPa (500 psi) which is considered to be acceptable.

The rest of the test bars which were compressed under a load of 422 MPa are pre-heated in air to about 500° C. in order to eliminate the gelatin and zinc stearate, and they are then sintered by being heated to about 1280° C. Traction tests carried out on the test bars sintered in this way give the following average results:

Elastic limit 137.9 MPa (20 ksi)

Breaking load 344.7 MPa (50 ksi)

Breaking elongation 25%.

According to the ASTM standard B525, the typical values for the mechanical properties of this 316 steel are:

Breaking load 413.7 MPa (60 ksi)

Breaking elongation 7%.

A comparative test is carried out on the same grade of 316 stainless steel using spherical particles with a maximum diameter not greater than 150 microns.

The agglomeration using gelatin is carried out with the same concentrations of gelatin and under the same sieving conditions as above, the diameter of the granules obtained not being greater than 500 microns. The size ratio between the granules and spherical particles is thus reduced to 3.3.

It will be noted that under these conditions a mechanical strength in the crude state of the test bars moulded under pressure is obtained which is much less than in the previous example, and it will also be noted that the traction test bars tend to crack during sintering.

In another comparative test, 316 steel is again used which is composed of particles with a diameter which is not greater than 106 microns. However, the size of the granules is reduced by final calibration through holes of 300 microns at the side. The size ratio is thus reduced to 2.8. It will be noted that by trying to mould traction test bars by cold compression, cracks are observed in them as soon as they are removed from the mould.

It is therefore seen that the size ratio of 3 between granules and elementary spherical particles is in the immediate vicinity of the acceptable limit, and that in practice it is advantageous to select a size ratio which is at least equal to 4.

EXAMPLE 2

The process described in Example 1 is carried out to produce a metallic powder agglomerated into granules starting with a 904 L type stainless steel containing in % by weight: Cr 20; Ni 25; Mo 4.5; Cu 2; remainder Fe.

The starting product comprises spherical particles which are not greater than 106 microns in diameter. Agglomeration is carried out in the same way as in the case of 316 steel described in Example 1, and final calibration of the granules is done by passing them through a sieve with a mesh size of 500 microns at the side, the size ratio between the granules and spherical particles being thus 4.7.

After traction test bars have been shaped by cold compression at a pressure of 422 MPa followed by sintering, these operations being carried out as in Example 1, the measurements taken of the mechanical properties in traction give the following results:

Breaking load in traction 448.2 MPa (65 ksi)

Breaking elongation: 15%.

A corrosion test carried out at ambient temperature with 1% of sulphuric solution gives no appearance of an attack after 48 hours.

These results, particularly set 2, show that the metallic powder according to the invention which comprises granules constituted by elementary spherical particles which are bonded by gelatin makes it possible for stainless steel pieces to be produced by compression and sintering which cannot be produced by the usual method used for angular powders, since it is difficult to imagine that these greatly alloyed steels could be produced by pulverisation in water owing to the oxygen content which would result.

A number of modifications or variants can be made to the characteristics of the powder agglomerated into granules which is the object of the invention, and also to the method according to the invention for preparing the powder which is agglomerated into particles from the spherical metallic particles of which it is composed.

These variants and modifications also form part of the invention.

We claim:

1. A metallic powder, capable of sintering after cold compression forming, wherein said metallic powder comprises an assembly of granules, each granule comprising a group of spherically shaped elementary metal particles agglomerated by gelatin, wherein the quantity of said gelatin is at least 0.5% of the weight of the metallic powder.

2. A metallic powder according to claim 1, wherein the maximum diameter $d_1$ of the spherical elementary particles and the maximum width $d_2$ of the granules are in a $d_2/d_1$ ratio of $\geqq 3$.

3. A metallic powder according to claim 2, wherein the $d_2/d_1$ ratio is $\geqq 4$.

4. A metallic powder according to any one of claims 1 to 3, wherein the content of gelatin in the granules is 1 to 5% of the weight of the metallic powder.

5. A metallic powder according to claim 1, wherein said metallic powder comprises a stainless steel or an alloyed steel.

6. A metallic powder according to claim 1, wherein said metallic powder comprises a non-oxidizing or fire-proof metal or alloy.

7. A process for the preparation of a metallic powder capable of sintering after cold compression forming, comprising the steps of:

mixing spherically shaped elementary metallic particles with an aqueous solution of gelatin in order to moisten the entire surface of the spherical particles, gelling the aqueous solution of gelatin to form a pasty mixture, and granulating the pasty mixture to obtain granules, each granule comprising a group of elementary particles, drying the granules the gelatin content of the granules being at least 0.5% by weight of the metallic powder.

8. A process according to claim 7, wherein the gelatin content is 1 to 5% by weight of the metallic powder.

9. A process according to claim 7 or claim 8, wherein said granulating step comprises passing the pasty mixture through at least one sieve to obtain granules and then drying the granules to obtain dried granules of width $d_2$ wherein the ratio between width $d_2$ and the maximum diameter $d_1$ of the spherical particles is at least equal to 3.

10. A process according to claim 9, wherein the ratio $d_2/d_1$ is at least equal to 4.

11. A metallic powder according to claim 3, wherein the $d_2/d_1$ ratio is at least 4.7.

12. A metallic powder according to claim 1, wherein the gelatin has a gelling strength between 50 and 250 Blooms.

13. A metallic powder according to claim 1, further comprising a lubricant.

14. A metallic powder according to claim 13, wherein the lubricant is zinc stearate.

15. A process according to claim 7, wherein said aqueous solution of gelatin comprises a quantity of water which is 2 to 5 times the quantity of gelatin.

16. A process according to claim 7, wherein the temperature of the aqueous solution of gelatin is 40°–80° C.

17. A process according to claim 7, wherein the metallic powder is selected from the group consisting of an alloyed steel, a non-oxidizing metal, a non-oxidizing metal alloy, a fire-proof metal and a fire-proof metal alloy.

* * * * *